US010156320B2

(12) United States Patent
Toelle

(10) Patent No.: US 10,156,320 B2
(45) Date of Patent: Dec. 18, 2018

(54) REMOTE ACTIVATION SYSTEM FOR A BREATHING APPARATUS FILLING STATION

(71) Applicant: Draeger Safety Canada Limited, Ontario (CA)

(72) Inventor: Jonathan George Toelle, Ontario (CA)

(73) Assignee: Draeger Safety Canada Limited, Ontario (CA)

( * ) Notice: Subject to any disclaimer, the term of this patent is extended or adjusted under 35 U.S.C. 154(b) by 132 days.

(21) Appl. No.: 15/106,265

(22) PCT Filed: Dec. 20, 2013

(86) PCT No.: PCT/CA2013/001063
§ 371 (c)(1),
(2) Date: Jun. 17, 2016

(87) PCT Pub. No.: WO2015/089619
PCT Pub. Date: Jun. 25, 2015

(65) Prior Publication Data

US 2016/0334061 A1 Nov. 17, 2016

(51) Int. Cl.
*F17C 5/06* (2006.01)
*F17C 13/02* (2006.01)
(Continued)

(52) U.S. Cl.
CPC ..... *F17C 5/06* (2013.01); *A62B 7/02* (2013.01); *A62B 9/006* (2013.01); *F17C 1/005* (2013.01);
(Continued)

(58) Field of Classification Search
CPC ..... F17C 5/06; F17C 13/04; F17C 13/084; F17C 13/025; F17C 1/005;
(Continued)

(56) References Cited

U.S. PATENT DOCUMENTS 5,570,685 A * 11/1996 Turiello ..... A62B 7/00 128/202.13
7,527,056 B2 * 5/2009 Turiello ..... A62B 13/00 128/203.27
(Continued)

FOREIGN PATENT DOCUMENTS

AU 2012201265 A1 9/2013
AU 2013201981 A1 9/2013
(Continued)

OTHER PUBLICATIONS

Extended European Search Report for European Application No. 13899563.4 dated Jul. 25, 2017.
(Continued)

*Primary Examiner* — Nicolas A Arnett
(74) *Attorney, Agent, or Firm* — Jones Day

(57) ABSTRACT

A Compressed Air Breathing Apparatus (CABA) or Self-Contained Breathing Apparatus (SCBA) is routinely used in environments when there is no breathable air and in emergency situations. However, CABA/SCBA tanks have limited capacity to hold compressed air, and BA filling stations are required in environments in which it may be necessary to refill the CABA/SCBA tanks during an emergency situation. Disclosed is a BA filling station system with a back-up air supply and remote activation. Two or more filling stations are interconnected by one or more air supply lines to provide a flow of compressed air between the filling stations, and one or more remote activation lines to control the flow. Advantageously, the system provides redundancy between the remotely located BA filling stations and substantially improves safety by making available a back-up source of an air supply from another interconnected filling station.

24 Claims, 9 Drawing Sheets

(51) Int. Cl.

| | |
|---|---|
| ***A62B 7/02*** | (2006.01) |
| ***A62B 9/00*** | (2006.01) |
| ***F17C 1/00*** | (2006.01) |
| ***F17C 13/04*** | (2006.01) |
| ***F17C 13/08*** | (2006.01) |

(52) U.S. Cl.
CPC ..... *F17C 13/025* (2013.01); *F17C 13/04* (2013.01); *F17C 13/084* (2013.01); *F17C 2201/0119* (2013.01); *F17C 2201/058* (2013.01); *F17C 2205/0146* (2013.01); *F17C 2205/0326* (2013.01); *F17C 2205/0335* (2013.01); *F17C 2205/0341* (2013.01); *F17C 2221/031* (2013.01); *F17C 2223/0123* (2013.01); *F17C 2223/035* (2013.01); *F17C 2225/0123* (2013.01); *F17C 2225/035* (2013.01); *F17C 2227/0157* (2013.01); *F17C 2227/043* (2013.01); *F17C 2250/043* (2013.01); *F17C 2260/02* (2013.01); *F17C 2270/025* (2013.01); *F17C 2270/079* (2013.01); *F17C 2270/0745* (2013.01)

(58) Field of Classification Search
CPC ..... F17C 2201/0119; F17C 2201/058; F17C 2205/0146; F17C 2205/0335; F17C 2205/0341; F17C 2205/0326; F17C 2270/025; F17C 2270/0745; F17C 2270/079; F17C 2260/02; F17C 2223/0123; F17C 2223/035; F17C 2227/0157; F17C 2227/043; F17C 2225/035; F17C 2225/0123; F17C 2221/031; A62B 7/02; A62B 9/006
See application file for complete search history.

(56) References Cited

U.S. PATENT DOCUMENTS

| | | | | |
|---|---|---|---|---|
| 7,621,269 | B2 * | 11/2009 | Turiello | A62B 13/00 128/200.24 |
| 7,673,629 | B2 * | 3/2010 | Turiello | E21F 11/00 128/200.24 |
| 7,677,247 | B2 * | 3/2010 | Turiello | A62B 7/02 128/203.27 |
| 7,694,678 | B2 * | 4/2010 | Turiello | A62B 7/02 128/200.24 |
| 8,371,295 | B2 * | 2/2013 | Turiello | A62B 15/00 128/202.13 |
| 8,375,948 | B2 * | 2/2013 | Turiello | A62B 13/00 128/200.24 |
| 8,381,726 | B2 * | 2/2013 | Turiello | A62B 7/02 128/200.24 |
| 8,413,653 | B2 * | 4/2013 | Turiello | A62B 13/00 128/200.24 |
| 8,443,800 | B2 * | 5/2013 | Turiello | A62B 7/02 128/200.24 |
| 8,701,718 | B1 * | 4/2014 | Turiello | A62B 13/00 128/202.13 |
| 9,242,126 | B2 * | 1/2016 | Turiello | A62B 15/00 |
| 9,243,753 | B2 * | 1/2016 | Wonders | F17C 5/06 |
| 2010/0037982 | A1 | 2/2010 | Bangs et al. | |
| 2012/0031525 | A1 | 2/2012 | Wonders | |

FOREIGN PATENT DOCUMENTS

| | | | |
|---|---|---|---|
| RU | 2241899 | C1 | 12/2004 |
| WO | 03/059742 | A1 | 7/2003 |
| WO | 2011/092562 | A2 | 8/2011 |
| WO | 2013/126943 | A1 | 9/2013 |

OTHER PUBLICATIONS

International Search Report and Written Opinion for application PCT/CA2013/001063, dated Sep. 15, 2014.
International Preliminary Report on Patentability for application PCT/CA2013/001063, dated Jun. 30, 2016.

* cited by examiner

REMOTE ACTIVATION SYSTEM FOR A BREATHING APPARATUS FILLING STATION

FIELD OF THE INVENTION

The present disclosure relates generally to breathing apparatus filling stations, and more particularly to breathing apparatus filling stations used for emergency situations.

BACKGROUND OF THE INVENTION

Breathing apparatus (BA) are routinely used in environments where there is no breathable air and in emergency situations where the availability or quality of air is not guaranteed. For example, in underground mines in an emergency situation workers are required to put in a BA as part of the emergency protocol.

Filling stations are required to refill the BAs so that they are ready for use and in situations where the BA is in use and must be refilled. Filling stations ordinarily fill BAs with compressed air (CA); giving rise to the term CABA (Compressed Air Breathing Apparatus). The term SCBA (Self-Contained Breathing Apparatus) may also be used to refer to the same or similar type of equipment. Therefore, for the purposes of the present discussion, these terms are used interchangeably. CABA/SCBA equipment has limited capacity in use, typically providing about an hour's worth of air before being depleted. Therefore, in some environments, multiple refills of CABA/SCBA equipment may be required while workers travel to safety, and therefore multiple filling stations may be provided at specified locations along an emergency escape-way or escape route. Furthermore, in some environments, there may be both a primary escape-way and secondary escape-way to provide redundant escape-ways and improve the chances of successfully escaping from an emergency situation. However, as these filling stations operate as stand-alone units, if only escape-way is used, the filling stations in that escape-way may be depleted quickly, while other filling stations in another escape-way may remain unused but unavailable.

Therefore, what is needed is an improved filling station system to address some of the limitations of existing filling station devices.

SUMMARY OF THE INVENTION

The present disclosure relates generally to a filling station system for a BA with remote activation. Two or more filling stations are interconnected by one or more air supply lines to provide a flow of compressed air between the filling stations, and one or more remote activation lines to control the flow. Advantageously, the system provides redundancy between the remotely located BA filling stations and substantially improves safety by making available a back-up source of an air supply from another interconnected filling station.

In an aspect, there is provided a filling station system for a breathing apparatus, comprising at least a first filling station having a first air bank system and a second filling station having a second air bank system. A first air supply line extending between the first filling station and the second filling station, the first air supply line adapted to supply a flow of air from the first air bank system to the second filling station, and a first user-operable activation device provided at or near the second filling station for remotely activating the flow of air from the first air bank system.

In an embodiment, a second air supply line extending between the second filling station and the first filling station, the second air supply line adapted to supply a flow of air from the second air bank system to the first filling station, and a second user-operable activation device is provided at or near the first filling station for remotely activating the flow of air from the second air bank system.

In another embodiment, at least one of the first air bank system and the second air bank system comprises a cascade air bank system.

In another embodiment, at least one of the first activation device and the second activation device comprises a remote control line or control channel adapted to transmit a control signal between the first and second filling stations.

In another aspect, there is provided a remote activation system for a breathing apparatus filling station. In an embodiment, a user-operable activation device is provided for remotely activating air flow between a first filling station having a first air bank system and a remote second filling station having a second air bank system, the first filling station and the second filling station having an air supply line extending therebetween. The activation device is located at or near the first filling station, and adapted to transmit a remote control signal to activate the flow of air from the second air bank system to the first filling station, whereby the volume of air from both first air bank system and second air bank system are available to recharge a breathing apparatus at the first filling station.

In an embodiment, the activation device comprises at least one control line or channel extending between the first filling station and the second filling station, the control line or channel adapted to transmit a control signal to start or stop the flow of air from the second air bank system to the first filling station. The activation device may be adapted to transmit a control signal air.

In another aspect, there is provided a method of operating a filling station system for a breathing apparatus. In an embodiment, the method comprises providing a first filling station having a first air bank system, providing a second filling station having a second air bank system, providing a first air supply line extending between the first filling station and the second filling station, the first air supply line adapted to supply a flow of air from the first air bank system to the second filling station, and activating a first control signal at or near the second filling station to remotely activate the flow of air from the first air bank system to the second filling station.

In an embodiment, the method further comprises providing a second air supply line extending between the second filling station and the first filling station, the second air supply line adapted to supply a flow of air from the second air bank system to the first filling station, and activating a second control signal at or near the first filling station to remotely activate the flow of air from the second air bank system to the first filling station.

In yet another aspect, there is provided a method of operating a remote activation system for a breathing apparatus filling station. In an embodiment, the method comprises providing a user-operable activation device located at or near a first filling station having a first air bank system, connecting the first filling station to a second filling station having a second air bank system with at least a first air supply line and a first control line or channel, and remotely activating air flow from the second air bank system to the first filling station, whereby the volume of air from both first air bank system and second air bank system are available to recharge a breathing apparatus at the first filling station.

Other features and advantages of the present invention will become apparent from the following detailed description and accompanying drawings. It should be understood, however, that the detailed description and specific examples are given by way of illustration and not limitation. Many modifications and changes within the scope of the present invention may be made without departing from the spirit thereof, and the invention includes all such modifications. Furthermore, as used herein, except where the context requires otherwise, the term "comprise" and variations of the term, such as "comprising", "comprises" and "comprised", are not intended to exclude further additives, components, integers or steps.

Figure 1A:
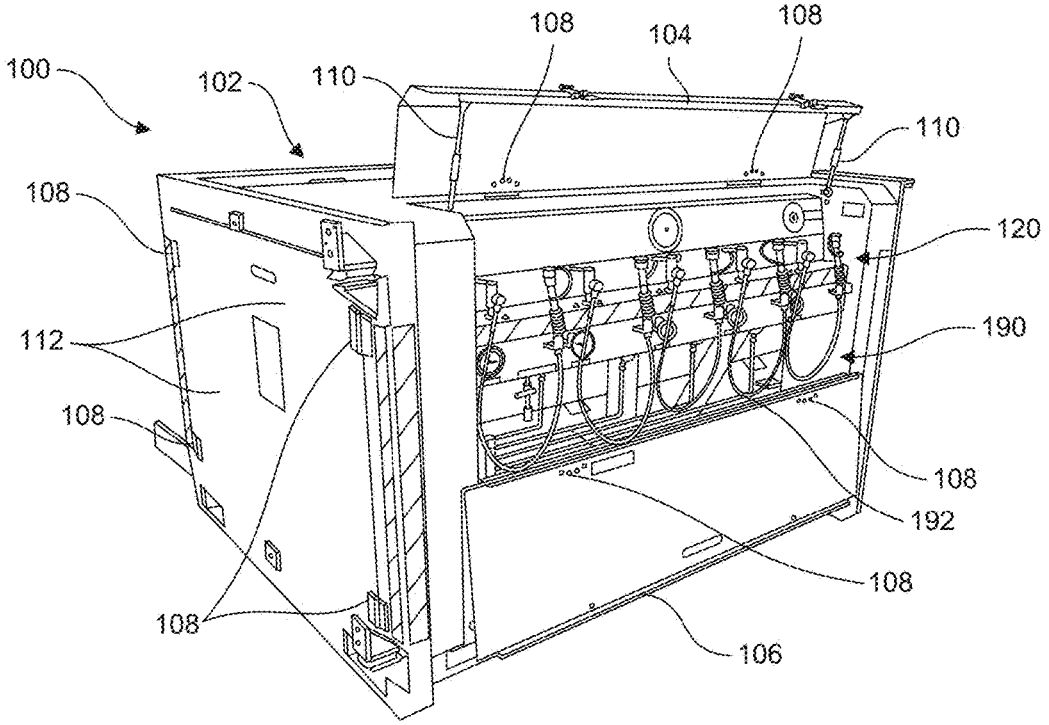
FIG. 1A shows an illustrative embodiment of a filling station.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

As noted above, the present disclosure relates generally to a filling station system for a BA with remote activation. Two or more filling stations are interconnected by one or more air supply lines to provide a flow of compressed air between the filling stations, and one or more remote activation lines to control the flow. Advantageously, the system provides redundancy between the remotely located BA filling stations and substantially improves safety by making available a back-up source of an air supply from another interconnected filling station.

While the present system is not limited to any specific configuration of a BA filling station, an illustrative embodiment of a suitable BA filling station design that may be adapted for use in an interconnected, redundant configuration in accordance with the present disclosure will now be described.

As detailed in co-pending International PCT application No. PCT/AU2012/000722 now published as WO 2013/126943 A1, and in co-pending Australian application No. 2013201981, the entire disclosures of which are hereby incorporated by reference herein, FIG. 1A shows one embodiment of a filling station 100. A cradle 102 of the filling station 100 comprises a top hatch 104, bottom hatch 106 and side doors 112 which open by swinging on hinges 108. Support struts 110 hold top hatch 104 up.

Cradle 102 fully encloses filling station 100 and is in the form of a cradle that has retaining brackets that enables forklift access from three or four sides.

High visibility indicators may be comprised on cradle 102 such as, bright paint and/or reflective decals. Cradle 102 may comprise a quick detachment system (QDS).

Suitably the cradle 102 is comprised of Mild Steel. However, other strong metals or other strong materials may be suitable. Based on the teachings herein a skilled person is readily able to select suitable materials for cradle 102.

In the embodiment show, cradle 102 has dimensions of 2000 mm Long×1670 mm Wide×1350 mm High. The dimensions may be varied to house the various components of filling station 100.

With the top and bottom hatches 104, 106 open, as shown in FIG. 1A, the fill panel 120 is visible. Fill panel 120 controls the air flow to ensure safe and quick recharging of one or more CABA/SCBA 198 (not shown). As will be described below, the logic of fill panel 120 makes possible the most effective use of the stored air pressure to maximize the number of CABA/SCBA fills.

Also visible is manifold 190 which comprises pipe 192 which connects various components of filling station 100. Manifold 190 comprises a network of pipe 192 and connectors which will be described below. In the embodiment shown manifold 190 comprises stainless steel ⅜" and ¼" tubes and connectors are used. In another embodiment manifold 190 may comprise coated mild steel and or flexible hose. The flexible hose may be used at the outlet of fill panel 120 to connect the fill panel 120 to the CABA/SCBA 198.

Figure 1B:
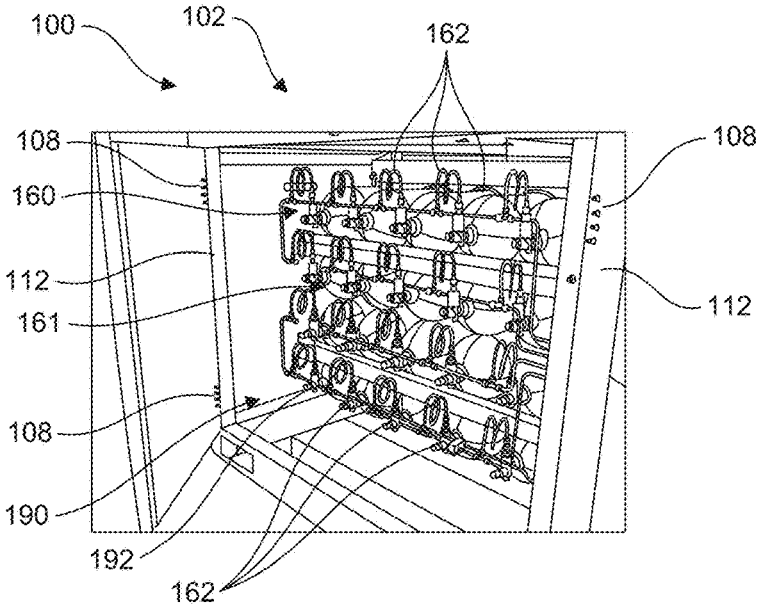
FIG. 1B shows the illustrative embodiment of FIG. 1A with the side door open.

Turning to FIG. 1B, which shows side doors 112 open, it can be seen that pipe 192 connects fill panel 120 to a cascade air bank system 160 which comprises a cylinder store 161. As will be described in more detail below the cylinder store 161 comprises twenty cylinders 162 separated into five banks 164-172 comprising bank 1 162; bank 2 166; bank 4 168; bank 4 170; and bank 5 172. Dividing the cascade air bank 160 into a plurality of banks increases efficiency and the number of refills that may be achieved using the filling station 100.

Figure 2:
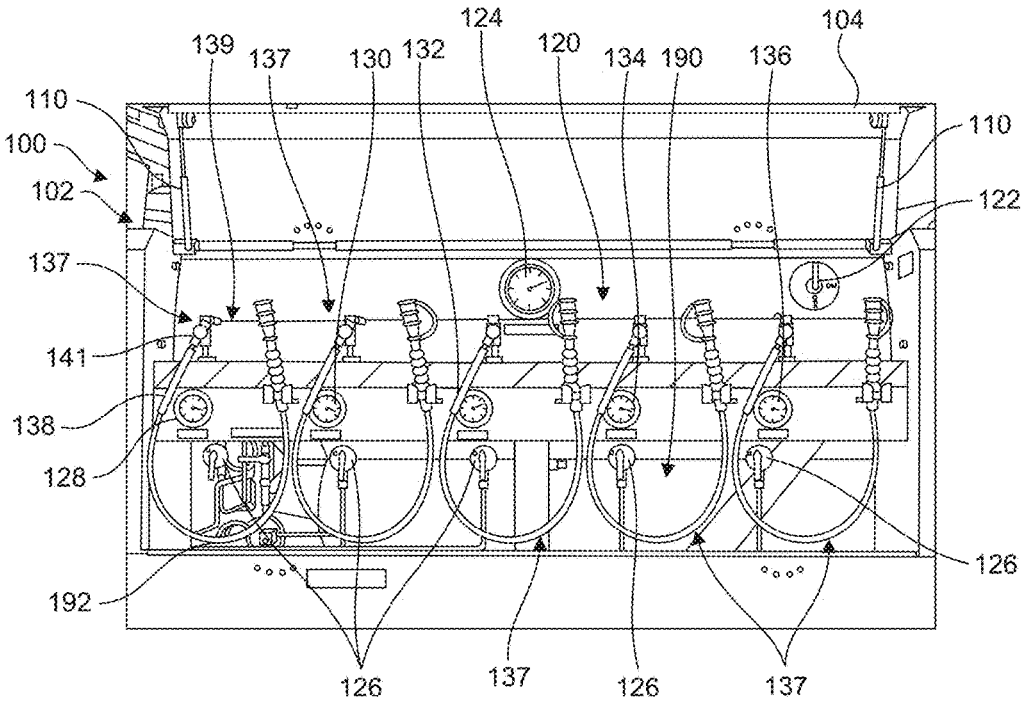
FIG. 2 shows an illustrative embodiment of a fill panel.
Figure 4:
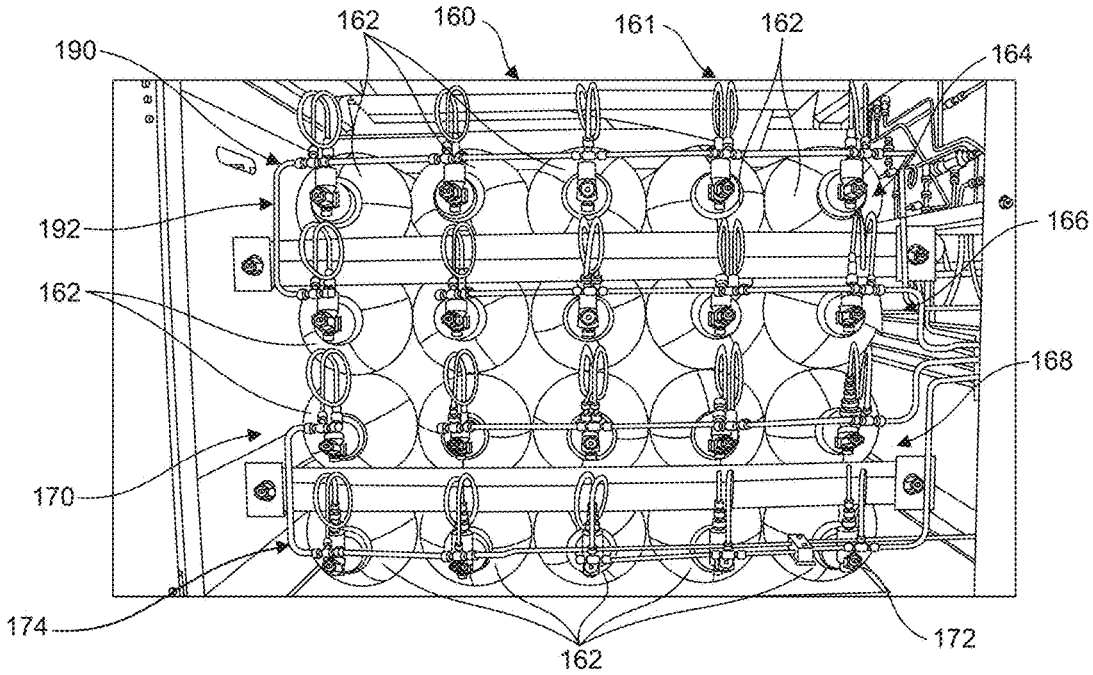
FIG. 4 shows a cascade air bank system and part of a manifold according to an illustrative embodiment.

FIGS. 2 and 4 show fill panel 120 in more detail, illustrates sequences valves 146, 148, 150, 152 which control the switching between banks 1 to 5 164, 166, 168, 170, 172 in order to achieve the quickest, most efficient and greatest number of CABA/SCBA fills. The switching may be automatic. Fill panel 120 comprises main shut off valve 122 and fill pressure indication gauge 124. Main shut off valve 122 comprises a ball valve manufactured by Prochem. Based on the teaching herein a skilled person is readily able to select other suitable valves such as those manufactured by Swagelok. Main shut off valve 122 can be turned to either "ON" or "OFF" to activate and deactivate filling station 100.

In use the fill pressure indication gauge 124 displays the pressure that is supplied to one or more CABA/SCBA 198 for filling.

Also visible in FIG. 2 are the five bank isolation valves 126; one for each of the five banks 164-172. The bank isolation valves 126 may be lockable to secure a setting. This opening and shutting off may be for filling or fir safe maintenance and transport.

In the embodiment shown, the five bank isolation valves 126 are ball valves.

Fill panel 120 also comprises pressure gauges 128-136 (first pressure gauge 128 for bank 1 164; second pressure gauge 130 for bank 2 166; third pressure gauge 132 for bank 3 168; further pressure gauge 134 for bank 4 170; and fifth pressure gauge 136 for bank 5 172); one pressure gauge for each of banks 1-5, 164-172. The provision of pressure gauges 128-136 makes it quick and easy to observe the pressure in each bank 164-172.

In the embodiment shown pressure gauges 128-136 are Wika 63 mm diameter, S/S case, —400 bar, liquid filled gauges.

As best seen in FIG. 2, fill panel 120 also comprises five CABA/SCBA fill attachments 137, which may be used to fill a corresponding CABA/SCBA 198. Each CABA/SCBA fill attachment 137 comprises a lever 139, a fill valve 140, fill hose 138 and a high pressure quick release coupling 141 for connecting to a CABA/SCBA 198 (the components are only labelled on the left hand side filled attachment 137). The quick release coupling 141 allows connection and disconnection to a CABA/SCBA 198 whether under pressure or not. In one embodiment the quick release coupling is a Normally Closed (NC) FD17 quick release fill adapter.

Fill valves 140 may comprise beer tap valves which are self vented so when a user closes the valve 140, the air in hose 138 will be released automatically.

When fill valves 140 are beer tap valves and they are combined with the quick release coupling 141, this combination allows a user to connect and disconnect under pressure. The venting provided by the beer tap valves makes the disconnecting easier and makes servicing easier and safer.

Provision of the five CABA/SCBA fill attachments 137 allows filling of five CABA/SCBA 198 (not shown) simultaneously.

Figure 3:
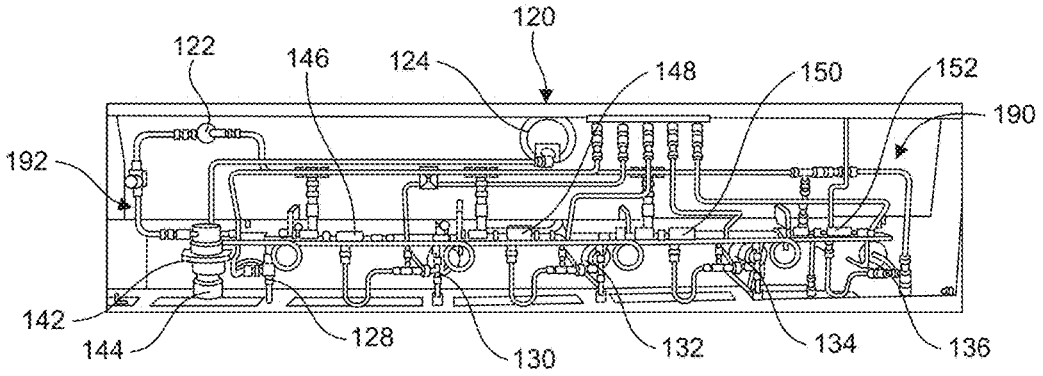
FIG. 3 shows a rear view of a fill panel according to an illustrative embodiment.

FIG. 3 shows a rear view of fill panel 120. The main shut off valve 122, fill pressure indication gauge 124 and pressure gauges 128-136 can all be seen, the rear view allows pressure regulator 142, orifice 144 and four sequence valves 146-152 to be seen. Orifice 144 restricts the flow and may create a delay so sequence valves 146-152 can sense the pressure.

In the embodiment shown the regulator 142 is a single stage self venting brass standard flow pressure regulator made by Aquatech Calif. USA.

The four sequence valves 146-152 control whether the filling of a CABA/SCBA (198) is from bank 1 164; bank 2 166; bank 3 168; bank 4 170 or bank 5 172. The sequence valves 146-172 control switching between banks 1-5, 164-172, i.e. the first sequence valve 146 controls switching between bank 1 164 and bank 2 166; the second sequence valve 148 controls switching between bank 2 166 and bank 3 168; the third sequence valve 150 controls switching between bank 3 168 and bank 4 170; and the fourth sequence valve controls switching between bank 4 170 and bank 5 172.

Each of the four sequence valves 146-152 may comprise a sequence valve lock 157 (not shown) to hold the sequence valve 146-152 in position. The sequence valve lock 157 is of significant advantage because it allows the positioning, e.g. fully open, partially open or closed, of a sequence valve 146-152 to be secured into position which prevents accidental adjustment during transport or use and protects sequence valves 146-152 against vibrations.

Lock 157 may be a locknut. In the embodiment shown sequence valve lock 157 comprise a brass made thin nut 158 which is adjustable along a thread 159 (not shown).

The cascade air bank system 160 which is illustrated in FIG. 4, comprises 20 cylinders 162 connected with pipe 192 to manifold 190. In the present embodiment each cylinder 162 comprises a 50 liter, high pressure cylinder with a nominal working pressure of 350 bar (Australia) or 6000 psi (North America), by way of example. A skilled person may use other suitable cylinders certified for use in different jurisdictions. While the present illustrative embodiment describes a cascade air bank configuration, in other embodiments, a conventional air bank that is not in a cascading configuration may also be used. For correct operation of the valves (not shown), all 20 cylinders 162 should be fully opened.

For compact packing, cylinders 162 are arranged in a 4 row×5 column matrix, however another suitable matrix may be used. Various efficient arrangements for the number of cylinders in each of banks 1-5 may be used, for example, as taught in International PCT application No. PCT/AU2012/000722, published as WO 2013/126943 A1.

Figure 5:
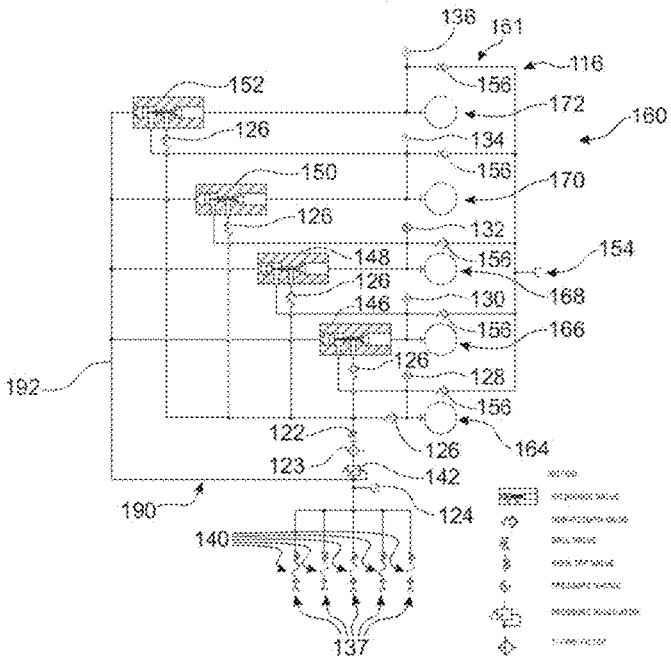
FIG. 5 is a schematic diagram showing one embodiment of a filling station.

A schematic diagram of the pneumatic circuit 116 comprised in filling station 100 is shown in FIG. 5. The relative position of banks 1-5, 164-172 and sequence valves 146-152 is shown; which illustrates that by locating first sequence valve 146 between the first bank 164 and the second bank 166, switching between these two banks 164 and 166 is accomplished. Similarly, by locating second sequence valve 148 between second bank 166 and third bank 168, switching between bank 166 and 168 is accomplished; by locating third sequence valve 150 between third bank 168 and fourth bank 170, switching between these banks 168 and 170 is accomplished; and by locating fourth sequence valve 152 between fourth bank 170 and fifth bank 172, switching between these banks 170 and 172 is accomplished.

FIG. 5 also shows the relative location of pressure gauges 128-136 as adjacent to the respective bank 164-172.

A filter 123 is also shown located between main shut off valve 122 and pressure regulator 142 so that filter 123 is positioned before orifice and between main shut off valve 122 and pressure regulator 142. Filter 123 may be an electronic filter, in the embodiment shown the filter 123 is a T-type filter. Based on the teaching herein a skilled person is readily able to select other suitable filters 123.

Another feature of filling station 100 is shown in FIG. 5, namely a recharging connection 154 which allows quick connection to a compressor 194 (not shown) or other recharging device (not shown) for recharging filling station 100.

Another feature of filling station 100 is provision of non-return valves 156 separating each bank 164-172 from compressor connection 154. In the embodiment shown the non-return valves 156 are Swagelok, stainless steel brand poppet check valves. Based on the teaching herein a skilled person is readily able to select other suitable valves.

Figure 6:
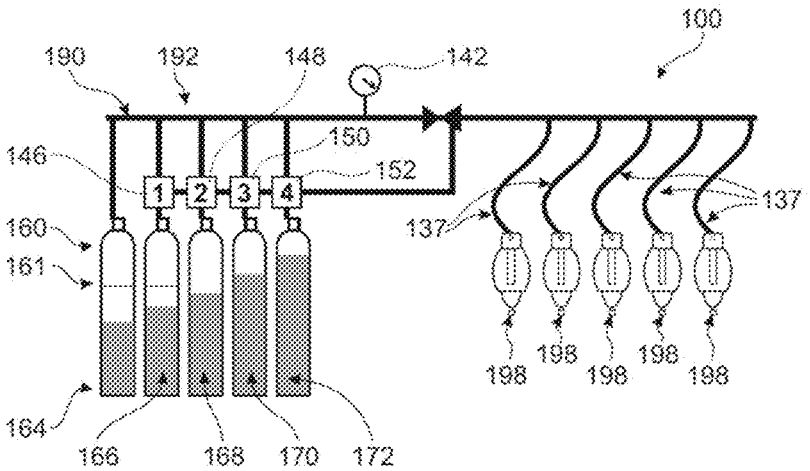
FIG. 6 is a schematic diagram showing one embodiment of the cascade air bank system.

The working principal behind the five stage cascade air bank system 160 is illustrated in FIG. 6. Five CABA/SCBAs 198 are shown attached to filling station 100. Sequence valves 146-152 compare the pressure in CABA/SCBA 198 with the pressure in the banks 164-172 and open a highest pressure bank partition. Under normal circumstances, i.e. when cylinder store 161 is fill or substantially full, this will be bank 1 164, followed in sequence by bank 2 166, bank 3 168, bank 4 170 and bank 5 172.

Further detail on the switching process is that sequence valves 146-152 are connected to manifold 190 from which the discharge pressure of the regulator 142 (which is similar to CABA/SCBA pressure), as limited by regulator 142, is detected and which should be the nominal fill pressure desired for filling a CABA/SCBA 198 and the supply pressure of the applicable bank 164-172 (i.e. as described above first sequence valve 146 controls switching between first bank 164 and second bank 166).

In the embodiment shown, pressure is detected on one side of a chamber divided by a piston type arrangement in sequence valve 146-152. The magnitude of the manifold pressure is enhanced by a spring so the pressures equalizes for example, at 250 bar pilot pressure and 280 bar supply pressure. When this pint is exceeded the relevant controls by sequence valves 146-152 controls the switching in cascade air bank system 160 to allow more air to flow from the previous bank (e.g. bank 1, 164, when switching is controlled by first sequence valve 146 from bank 1, 164 to bank 2, 166) because the pressure is lower.

In one embodiment the pressure regulator 142 is set to 300 bar and ensures that the CABA/SCBA 198 is not overfilled.

When the pressure in the starting bank (when cylinder store 161 is full or substantially full, this will be bank 1 164) is not sufficient, filling station 100 automatically switches to the bank 164-172 with the next highest pressure until 300 bar is shown on fill pressure indication gauge 124.

Once the CABA/SCBA 198 is connected to the CABA/SCBA fill attachment 137, fill valves 140 can be opened and the fill process monitored on the pressure gauge(s) on the CABA/SCBA 198. When 300 bar or the desired pressure is reached the self-venting or fill valve(s) 140 can be closed by operating lever(s) 139.

Figure 7:
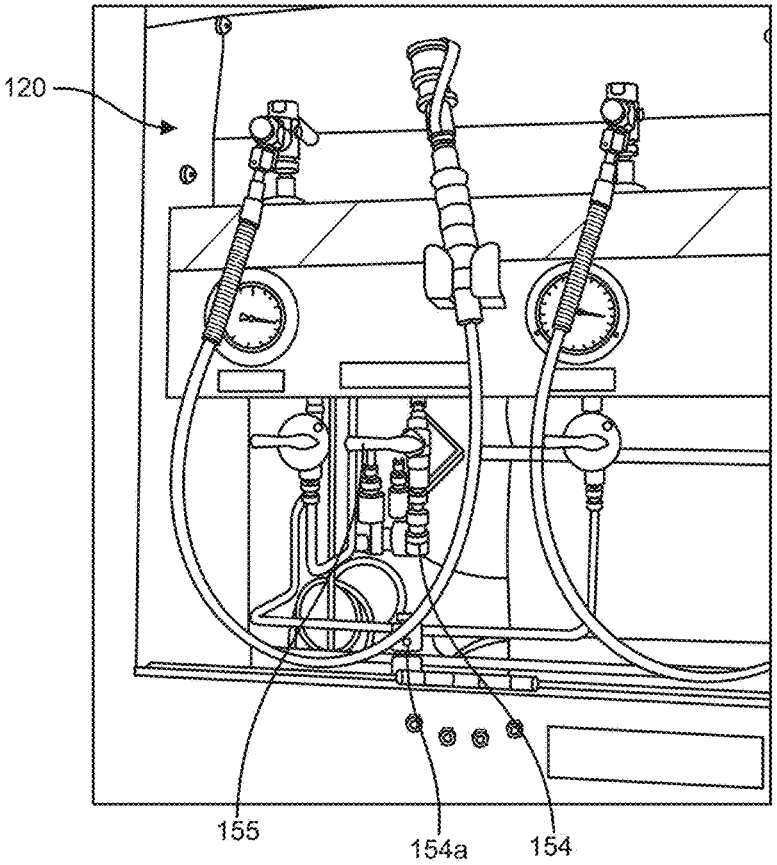
FIG. 7 shows a section of a fill panel according to an embodiment.

As discussed above, filling station 100 comprises a recharging connection 154 for connection to a compressor 194 or other recharging device for recharging filling station 100. The location of recharging connection 154 comprised on fill panel 120 is shown in FIG. 7. In the embodiment shown recharging connection 154 comprises a shut-off valve 155 and a high pressure quick release coupling 154*a*.

While heretofore an illustrative example of a suitable filling station 100 for use in the system has been described, these are stand-alone stations that provide refilling capability along an emergency escape-way or escape route. While these stations provide high efficiency in refilling as described above, as will now be detailed with reference to FIGS. 8A and 8B, the reliability of these filling stations 100 may be further improved by interconnecting a plurality of remotely located filling stations 100 with a plurality of air supply lines and remote activation lines, as will be described in further detail below.

Figure 8A:
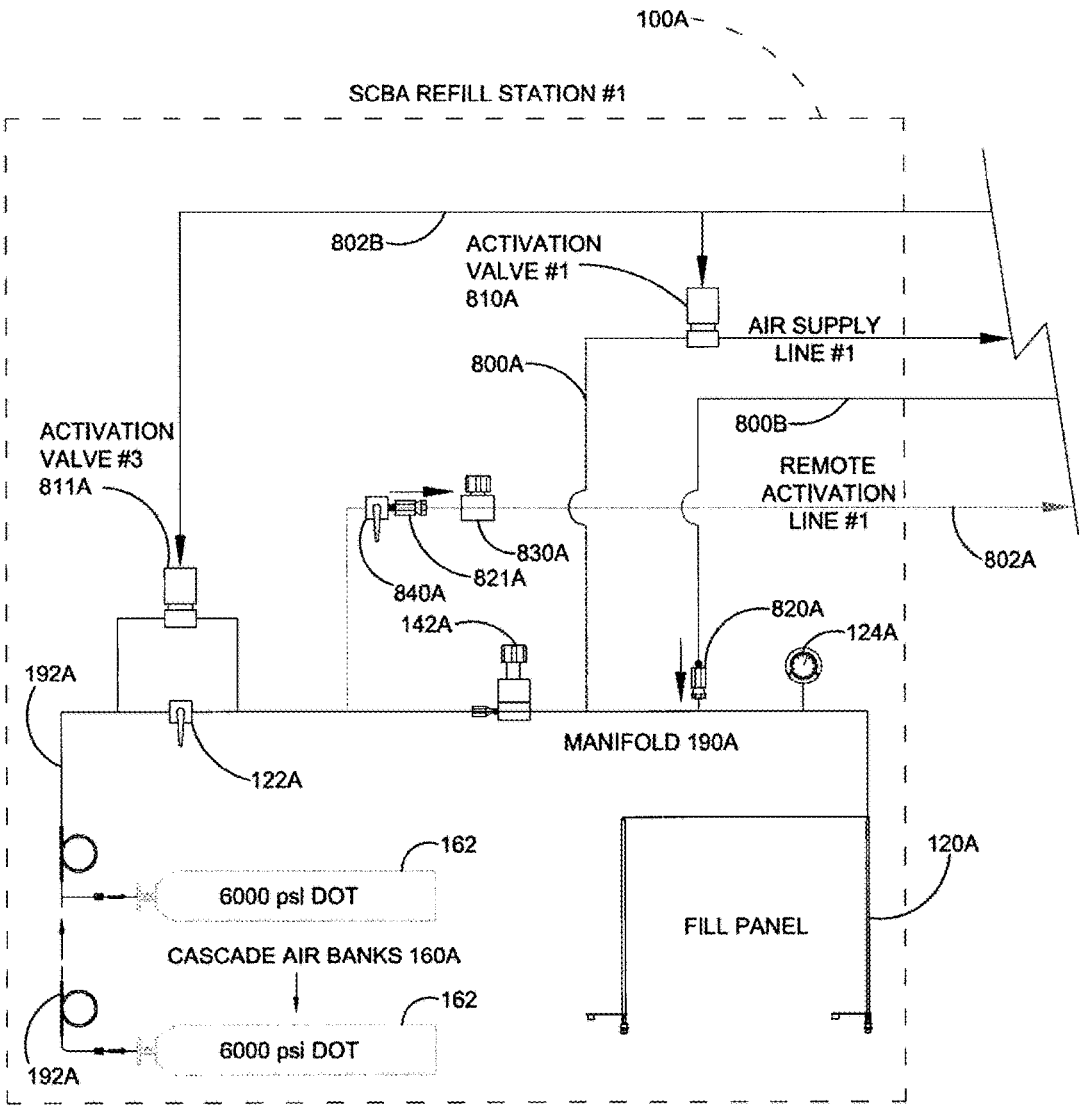
FIGS. 8A to 8D show schematic block diagrams of interconnected filling stations in accordance with illustrative embodiments.

Shown in FIG. 8A is an illustrative first filling station 100A in stippled block outline. Within filling station 100A is a simplified view of the cascade air bank system 160A described in detail earlier, with a plurality of cylinders 162. The plurality of cylinders 162 may be configured into a plurality of banks 164-172 in a cascade air bank system 160 as earlier described. However, while desirable, a cascade air bank system 160 is not necessary to the operation of an interconnected filling station system, and based on the teaching herein a skilled person is readily able to select other suitable cylinder bank configurations (not shown) for use in first filling station 100A.

As shown in this illustrative example, the cascade air bank system 160A is connected by a network of pipe 192A and connectors which connects the plurality of cylinders 162 to a manifold 190A, a user-operated main shut off valve 122A can be turned to either "ON" or "OFF" to control the flow of compressed air from the cascade air bank system 160A, activating and deactivating filling station 100A. Manifold 190A connects main shut off valve 122A to the pressure regulator 142A. The compressed air pressure of the regulator 142A is the desired CABA/SCBA fill pressure. A fill panel 120A provides flexible hoses to connect one or more CABA/SCBA 198 tanks for filling. In use the fill pressure indication gauge 124 displays the pressure that is supplied to one or more CABA/SCBA for filling.

Figure 8B:
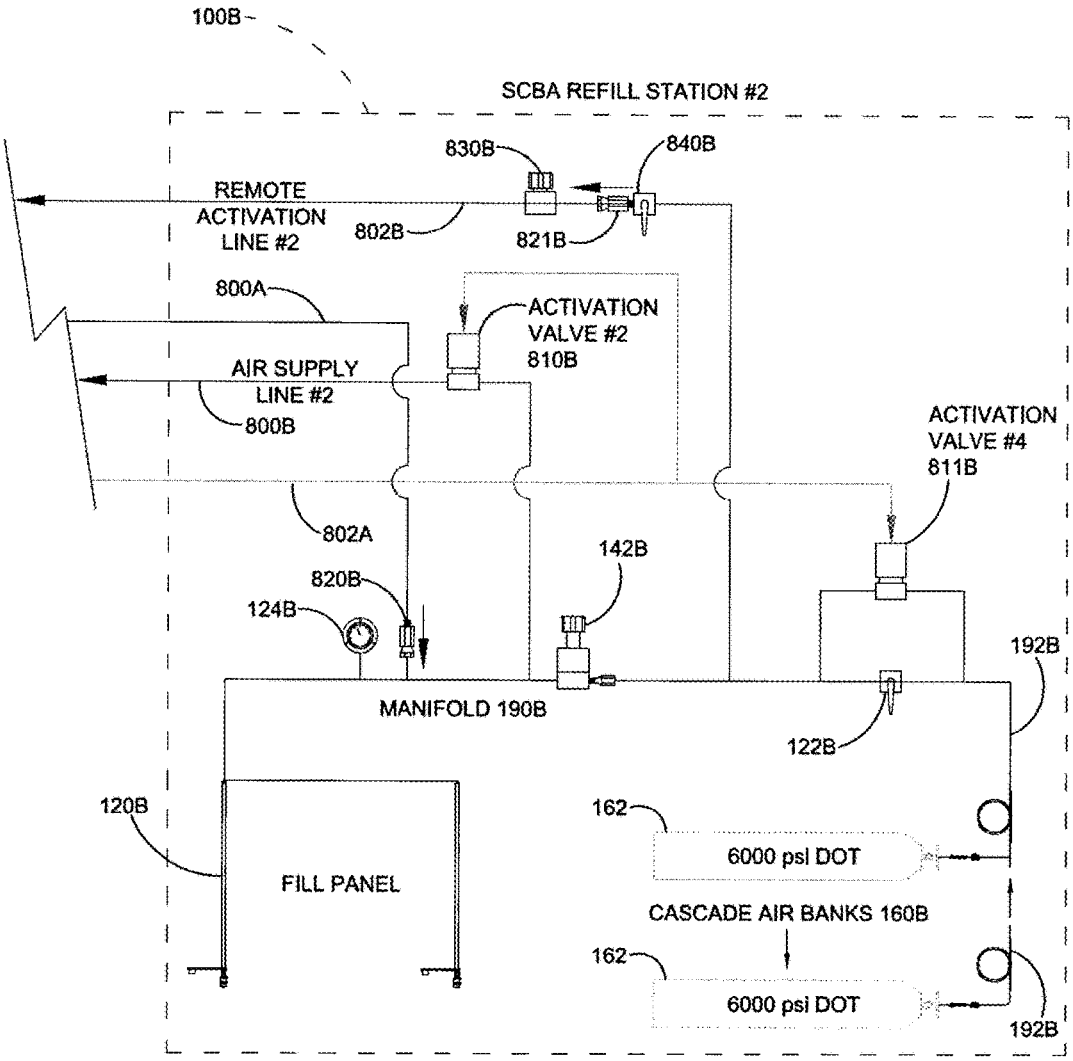

Correspondingly, a second filling station 100B is illustrated in FIG. 8B in stippled block outline, and also shows a second cascade air bank system 160B connected by a network of pipe 192 and connectors to connect a plurality of cylinders 162 to an inlet of manifold 190B. Manifold 190B connects main shut off valve 122B to pressure regulator 142B. User-operated main shut off valve 122B can be turned to either "ON" or "OFF" to control the flow of compressed air from the cascade air bank system 160B, activating and deactivating filling station 100B.

Referring to FIGS. 8A and 8B together, first filling station 100A and second filling station 100B are remotely located with respect to each other, but interconnected by first and second air supply lines 800A and 800B, respectively. The first and second air supply lines 800A and 800B are high pressure lines and of sufficient length to extend the entire distance between first filling station 100A and second filling station 100B.

In a possible application such as mining, while escape-ways may be long, perhaps running several tens of thousands feet or more, primary escape-ways and secondary escape-ways may run substantially parallel to each other, perhaps being separated by several tens of feet, or perhaps several hundreds of feet or more. The distance should be reasonable to allow drilling through any obstacles to allow a length of air supply lines and remote control lines to be connected between the first and second filling stations 100A, 100B. Where longer runs than several hundreds of feet are required, it may be necessary to utilize wired or wireless electronic controls over suitable electronic control lines or wireless control channels where operational conditions permit.

In an embodiment, the air supply lines and remote control lines may be grouped together in a protective sleeve which may run the length of the obstacle between the first and second filling stations 100A, 100B.

In another embodiment, the air supply line 800B is a pneumatic hose or pipe capable of sending high-pressure air from one or more back-up cascade air bank systems (cascade air bank 160B) located at a remote filling station (second filling station 100B) to the local filling station (first filling station 100A) fill panel 120A by turning on main shut off valve 122A in the fill panel 120A. The main shut off valve may be a manual quarter-turn ball valve, such as Trunnion-Style, 83 and H83 Series ball valves from Swagelok, for example. Based on the teaching herein a skilled person is readily able to select other suitable valves.

Air supply line 800B is connected to an air bank activation valve 810B which activates or stops the flow of compressed air from cascade air bank system 160B. Air bank activation valve 810B receives a control input from the location of first filling station 100A via a remote activation line 802A.

In another embodiment, the air bank activation valve 810B is pneumatically controlled and adapted to receive a control signal air from remotely located filling station 100A. The control signal air from filling station 100A is activated by a user-operable activation device, as described further below. In an illustrative embodiment, activation valve 810B may be a pilot air valve, such as air valve model 816-1 from Aqua Environment Inc. capable of handling up to 6000 psi.

In this embodiment, the control signal air is low to medium pressure air. Control signal is transmitted to air bank activation valve 810B via remote activation line 802A. In an illustrative embodiment, air bank activation valves

810A and 810B are constructed such that the low to medium pressure control signal air and a return spring act on an internal piston to operate the activation valve. In this embodiment, the return spring will cause the internal piston to close the activation valve in the case of loss of control signal air pressure.

In this illustrative embodiment, second air bank activation valves 811A and 811B are constructed with substantially identical build and operation to activation valves 810A & 810B, and operate to turn on or activate the refill station where valves 122A & 122B are located.

The corresponding remote activation line 802A is a pneumatic line capable of sending a low to medium pressure (e.g. 50 psi-250 psi) air signal from the location of first filling station 100A via a user-operable activation device.

In another embodiment, compressed air pressure in remote activation line 802A is controlled by low or medium pressure regulator 830A. In the embodiment shown the reducing regulator is an Aqua Environment brand, model 969 reducing regulator. Based on the teaching herein a skilled person is readily able to select other suitable regulators.

When the main shut-off valve 122A is activated in first filling station 100A the remote activation line 802A is supplied with air via the network of pipe 192A.

A non-return valve 821A prevents any backflow of air through the remote activation line 802A. In the embodiment shown the non-return valves 821A are Aqua Environment brand, aluminum-body, brass-poppet check valves. Based on the teaching herein a skilled person is readily able to select other suitable valves.

In an alternative embodiment, the air bank activation valve 810B may be electric (e.g. a solenoid valve) and the corresponding remote activation line 802A may provide an electric control signal via a length of wire from a user-operable activation device located at or near first filling station 100A. However, such electrical devices must be properly approved for use on environments with potentially highly flammable materials. The electric control signal may also be provided wirelessly with suitable wireless transceivers provided at each of first and second filling stations 100A, 100B if the operating environment allows wireless signals to pass between first and second filling stations 100A and 100B at their respective remote locations.

Correspondingly, air supply line 800A is connected to an air bank activation valve 810A which activates or stops the flow of compressed air from cascade air bank system 160A. Air bank activation valve 810A receives a control input from the location of second filling station 100B via a remote activation line 802B.

As described above, each of first and second filling stations 100A and 100B include a user-operable activation device used to send a control signal to the respective other filling station 100B, 100A to call for air from the remote air bank. While the control signal may be pneumatic, electric, or wireless, in this illustrative embodiment, the user-operable activation device is implemented as valves 840A, 840B which may be used to send control signals to the respective other filling station 100B, 100A via respective remote activation lines 802A and 802B. Valves 840A, 840B may be of the same type used for the main shut-off valves 122A, 122B described earlier. Valves 840A, 840B may also act as safety shut-off valves which may be used to effectively sever the interconnection between first and second filling stations 100A and 100B to prevent further loss of air, for example through a damaged or severed air supply line. In an embodiment, the safety shut-off valves 840A, 840B may be a manual quarter-turn ball valve, such as Trunnion-Style, 83 and H83 Series ball valves from Swagelok, for example. Based on the teaching herein a skilled person is readily able to select other suitable valves. In an embodiment, the safety shut-off valve 840A, 840B could be manually activated by the user at a local filling station fill panel to prevent further flow of air from the local filling station to a remote filling station. In another embodiment, the safety shut-off valve 840A, 840B is pneumatic, and a shut-off control signal is transmitted by cutting off an air signal from a filling station fill panel. In another embodiment, the safety shut-off valve 840A, 840B could be electronic (a wired or wireless signal) to remotely trigger the shut-down of air flow.

In use, when air bank activation valve 810B is in an open position, a flow of compressed air from cascade air bank system 160B is supplied across the air supply line 800B to the inlet of manifold 190A.

A non-return valve 820A, which may be of the same type and model as non-return valve 821A, prevents any backflow of air into the supply line 800B and prevents an undesired loss of pressure. Based on the teaching herein a skilled person is readily able to select other suitable valves.

The flow of compressed air supplied across air supply line 800B may combine with any compressed air flowing from the cascade air bank system 160A, and thus compressed air from both cascade air bank system 160A and cascade air bank system 160B may be controlled from the location of first filling station 100A via main shut-off valve 122A and remote activation line 802A.

Similarly, when air bank activation valve 810A is in an open position, a flow of compressed air from cascade air bank system 160A is supplied across the air supply line 800A to the inlet of manifold 190B.

Air bank activation valve 810A is adapted to be remotely controlled from the location of the first filling station 100B via remote activation line 802B. Once again, the flow of compressed air from cascade air bank system 160A may combine with the flow of compressed air from cascade air bank system 160B to be made available at fill panel 120B.

Given the teachings of the above illustrative example, it will be appreciated by those skilled in the art that that various modifications may be made to the layout and configuration of the lines and valves. For example, it is possible to move regulators 142A and 142B such that they are connected prior to valves 122A and 122B respectively. Various other modifications to the layout are possible but would all involve a combination of control signal lines or channels, air supply lines, and activation devices as described above.

Advantageously, by interconnecting remotely located filling stations, and providing the ability to remotely control activation of a remotely located filling station, one filling station may serve as a redundant backup of another. Therefore, by interconnecting two filling stations located in different escape-ways, even if only one of the escape-ways is being used, the filling stations located in the other unused escape-way may still be accessed and used remotely as a redundant back-up supply.

Furthermore, by increasing the volume of compressed air available for CABA/SCBA refill at either filling station by activating filling station cascade air bank systems 160A and 160B and combining the air from both cascade air bank systems 160A and 160B, the filling capacity of each filling station may be virtually doubled, although a safety feature may be provided which would maintain a minimal pressure in a cascade air bank system in order to maintain at least a minimum amount of refill capacity.

In addition, by combining the volume of compressed air available for CABA/SCBA refill from both cascade air bank systems 160A and 160B, the filling speed of a number of CABA/SCBA at a refilling station may be substantially increased.

While the illustrative embodiment shown in FIGS. 8A and 8B operates bi-directionally, it is also possible to configure a system which is unidirectional, with a remotely located back-up filling station that may be remotely activated to supply a local filling station. This configuration provides a physically separated back-up system, and may also remove the need to provide a cascade air bank system in one filling station.

Furthermore, while the illustrative embodiment shown in FIGS. 8A and 8B shows the controls provided as part of the first and second filling stations 100A, 100B, it will be appreciated that the remote activation control and safety shut-off may be configured as a separate component outside the main housing of the first and second filling stations 100A, 100B, although such controls should be in the immediate vicinity for easy access.

Figure 8C:
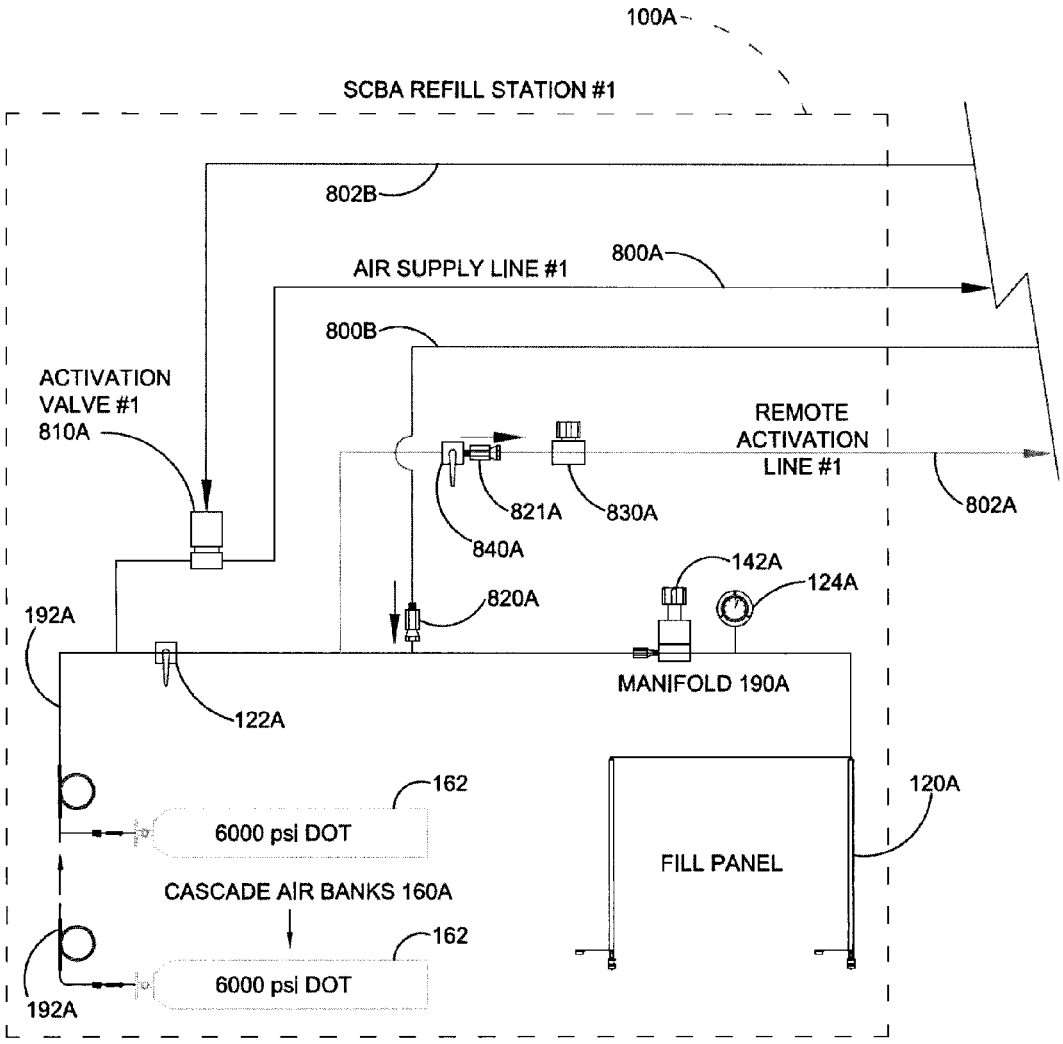
Figure 8D:
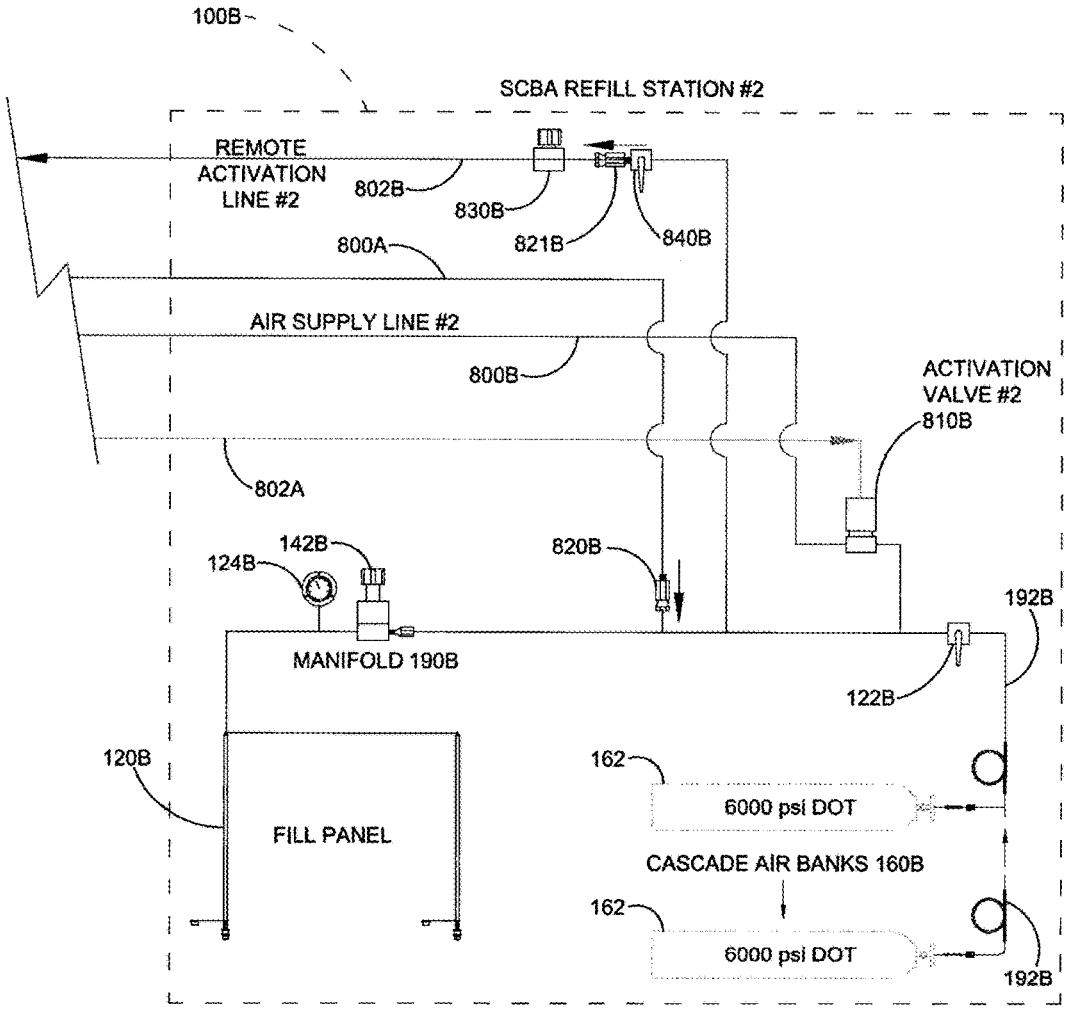

FIGS. 8C and 8D show an alternative embodiment which is configured to allow for an additional feature of remotely refilling cascade air bank systems 160A, 160B. With this configuration, it is no longer necessary to physically go to both filling stations 100A, 100B to recharge the air bank systems 160A, 160B. Rather, recharging may take place from a single location to refill the compressed air storage cylinders 162 in cascade air bank systems 160A, 160B thereby saving a significant amount of time during recharging. In this embodiment, both cascade air bank systems 160A, 160B are placed into recharge modes and are recharged from the location of filling station 100A, for example. The recharging may be performed in sequence (i.e. filling station 100A is fully charged before filling station 100B begins recharging), or may be in parallel (i.e. both filling station 100A and filling station 100B begin recharging at the same time.

Figure 9A:
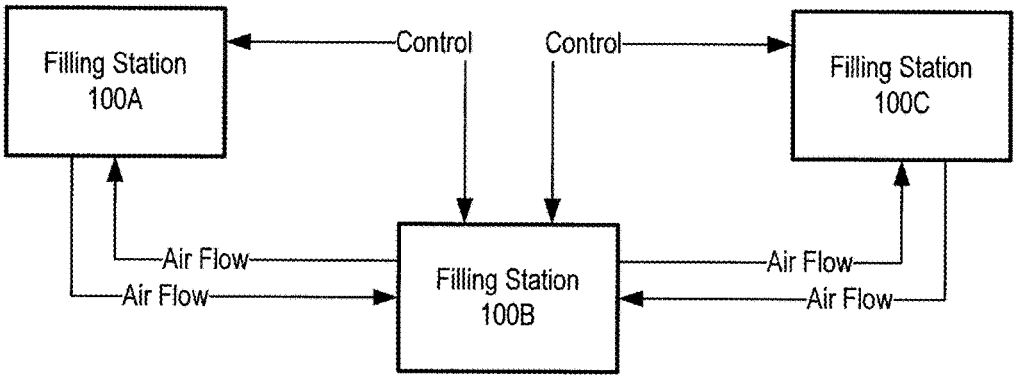
FIGS. 9A to 9C show schematic block diagrams extending the interconnections between more than two filling stations.

While the interconnection of first and second filling stations 100A and 100B has been shown and described by way of illustration, it will be appreciated by those skilled in the art that the teachings of the present disclosure may be extended to more than two filling stations. By way of example, FIG. 9A provides a schematic illustration in which filling station 100B is interconnected with both filling station 100A and filling station 100C. In this configuration, filling station 100A and filling station 100B are able to control each other, and filling station 100B and filling station 100C are also able to control each other. However, in this example, there is no direct control between filling station 100A and filling station 100C as both are back-up filling stations for filling station 100B. In turn, filling station 100B may act as a back-up to either filling station 100A, or filling station 100C.

Figure 9B:
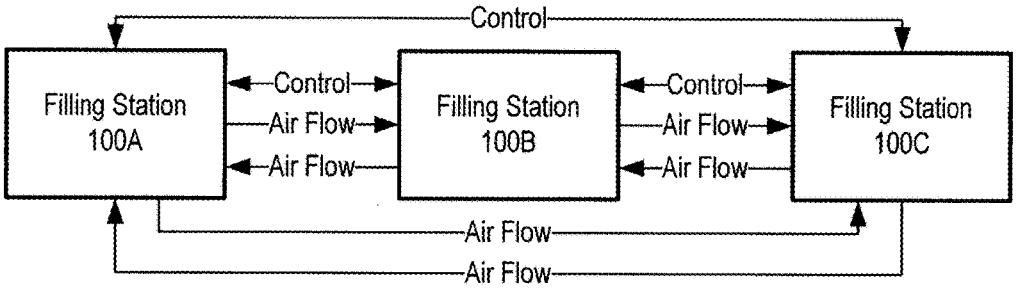

As another example, shown in FIG. 9B is a configuration where all three filling stations 100A, 100B, 100C are able to control each other, and provide air flow between each pair of filling stations.

Either configuration in FIG. 9A or 9B may be used, for example, in an environment where three escape-ways run substantially parallel with each other, and filling stations are provided as sets of three periodically along their length.

Figure 9C:
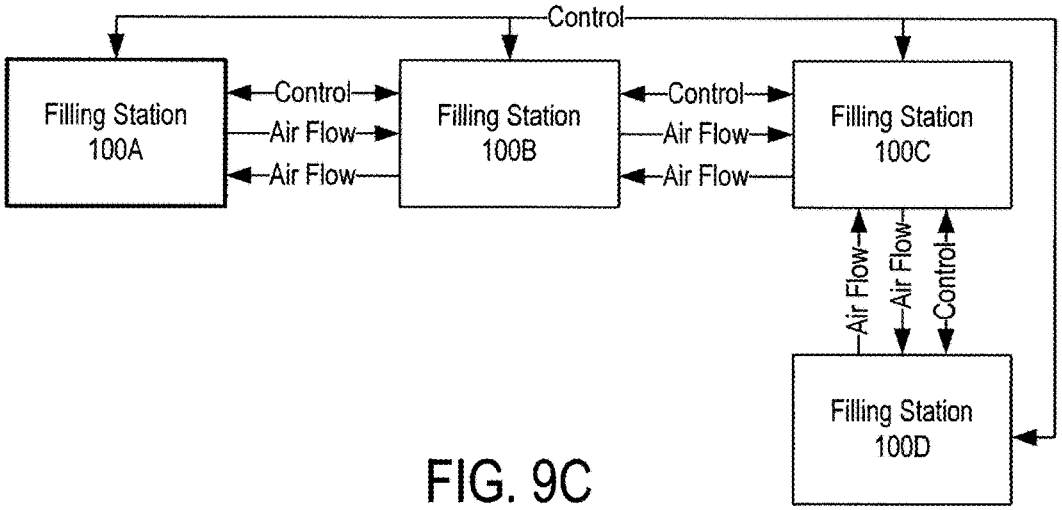

Still another example, as shown in FIG. 9C, is a daisy-chain configuration in which a plurality of filling stations 100A to 100D could be daisy-chained in order to share a volume of air between any of the filling stations 100A to 100D. For example, in an illustrative embodiment, unused air from filling stations 100A and 100B could be available to the next filling stations 100C and 100D in the daisy-chain, such that an escape party could maximize the amount of air available along its escape way. Alternatively, an escape party further back in the escape-way at filling station 100A or 100B could call for additional air to be transferred from one or more of filling stations 100C and 100D. As also illustrated in FIG. 9C, in another embodiment, a control line or control channel may be utilized to exchange control signals between more than two filling stations.

Whether configured as a uni-directional system, a bi-directional system, or a multi-directional system involving more than two filling stations as illustrated in FIGS. 9A to 9C, it will be appreciated that the safety factor of each filling station is substantially increased by building in redundant components. The configurations may be extended even further, for example by providing redundant control lines, or redundant air flow lines for flow in each direction.

While a particular example of use in a mining escape-way application has been described by way of example, it will be appreciated that the system could be adapted for use in any other industry where CABA/SCBA equipment may be used in an escape function. For example, applications may be found in a chemical plant, oil and gas processing facilities, or in any closed environment in which the capacity of the CABA/SCBA equipment may exhausted before escape has been completed.

Thus, in an aspect, there is provided a filling station system for a breathing apparatus, comprising: a first filling station having a first air bank system; a second filling station having a second air bank system; a first air supply line extending between the first filling station and the second filling station, the first air supply line adapted to supply a flow of air from the first air bank system to the second filling station; and a first user-operable activation device provided at or near the second filling station for remotely activating the flow of air from the first air bank system.

In an embodiment, the filling station system further comprises: a second air supply line extending between the second filling station and the first filling station, the second air supply line adapted to supply a flow of air from the second air bank system to the first filling station, and a second user-operable activation device provided at or near the first filling station for remotely activating the flow of air from the second air bank system.

In another embodiment, at least one of the first air bank system and the second air bank system comprises a cascade air bank system.

In another embodiment, at least one of the first activation device and the second activation device comprises a remote control line or control channel adapted to transmit a control signal between the first and second filling stations.

In another embodiment, the control signal comprises a control signal air transmitted a low to medium pressure between about 50 psi to 250 psi.

In another embodiment, the filling station system further comprises one or more additional filling stations connected in series with the first filling station or the second filling station, each of the one or more additional filling stations having an air bank system, and an air supply line connecting the air bank system to at least one other filling station, thereby to make available a volume of air from more than one air bank system at one of the filling stations.

In another embodiment, the filling station system further comprises a user-operable activation device located at or near each filling station, a remote control line or control channel adapted to transmit a control signal between filling stations.

In another embodiment, a control line or control channel is adapted to transmit a control signal to more than one filling station.

In another embodiment, the first filling station and the second filling station are adapted to be placed in a recharging mode, whereby both the first filling station and the second filling station are recharged either from the location of the first filling station or the location of the second filling station.

In another aspect, there is provided a remote activation system for a breathing apparatus filling station, comprising: a user-operable activation device for remotely activating air flow between a first filling station having a first air bank system and a remote second filling station having a second air bank system, the first filling station and the second filling station having an air supply line extending therebetween; wherein, the activation device is located at or near the first filling station, and adapted to transmit a remote control signal to activate the flow of air from the second air bank system to the first filling station, whereby the volume of air from both first air bank system and second air bank system are available to recharge a breathing apparatus at the first filling station.

In another embodiment, the activation device comprises at least one control line or channel extending between the first filling station and the second filling station, the control line or channel adapted to transmit a control signal to start or stop the flow of air from the second air bank system to the first filling station.

In another embodiment, the activation device is adapted to transmit a control signal air.

In another embodiment, the control signal air comprises a low to medium pressure between about 50 psi to 250 psi.

In another embodiment, the activation device comprises a wired or wireless electronic control device adapted to transmit a wired or wireless electronic control signal over a control line or control channel between the first filling station and the second filling station.

In another aspect, there is provided a method of operating a filling station system for a breathing apparatus, comprising: providing a first filling station having a first air bank system; providing a second filling station having a second air bank system; providing a first air supply line extending between the first filling station and the second filling station, the first air supply line adapted to supply a flow of air from the first air bank system to the second filling station; and activating a first control signal at or near the second filling station to remotely activate the flow of air from the first air bank system to the second filling station.

In another embodiment, the method further comprises: providing a second air supply line extending between the second filling station and the first filling station, the second air supply line adapted to supply a flow of air from the second air bank system to the first filling station, and activating a second control signal at or near the first filling station to remotely activate the flow of air from the second air bank system to the first filling station.

In another embodiment, the method further comprises providing a cascade air bank system for at least one of the first air bank system and the second air bank system.

In another embodiment, activating the first control signal or the second control signal comprises transmitting a control signal air between the first and second filling stations over a remote control air line.

In another embodiment, the method further comprises transmitting the control signal air at a low to medium pressure between about 50 psi to 250 psi.

In another embodiment, the method further comprises providing one or more additional filling stations connected in series with the first filling station or the second filling station, each of the one or more additional filing stations having an air bank system, and an air supply line connecting the air bank system to at least one other filling station.

In another embodiment, the method further comprises placing the first filling station and the second filling station into a recharging mode, and recharging both the first filling station and the second filling station either from the location of the first filling station or the location of the second filling station.

In another aspect, there is provided a method of operating a remote activation system for a breathing apparatus filling station, comprising: providing a user-operable activation device located at or near a first filling station having a first air bank system; connecting the first filling station to a second filling station having a second air bank system with at least a first air supply line and a first control line or channel; and remotely activating air flow from the second air bank system to the first filling station, whereby the volume of air from both first air bank system and second air bank system are available to recharge a breathing apparatus at the first filling station.

While various embodiments and illustrative examples have been described above, it will be appreciated that these embodiments and illustrative examples are not limiting, and the scope of the invention is defined by the following claims.

The invention claimed is:

1. A filling station system for a breathing apparatus, comprising:

a first filling station having a first air bank system;

a second filling station having a second air bank system;

a first air supply line extending between the first filling station and the second filling station, the first air supply line adapted to supply a flow of air from the first air bank system to the second filling station;

a first user-operable activation device provided at or near the second filling station for remotely activating the flow of air from the first air bank system; and a first activation valve coupled to the first air supply line and controlled by the first user-operable activation device, the first activation valve configured to activate or stop airflow between the first air bank system and the second air bank system.

2. The filling station system of claim 1, further comprising:

a second air supply line extending between the second filling station and the first filling station, the second air supply line adapted to supply a flow of air from the second air bank system to the first filling station, and a second user-operable activation device provided at or near the first filling station for remotely activating the flow of air from the second air bank system.

3. The filling station of claim 2, further comprising a second activation valve coupled to the second air supply line and controlled by the second user-operable activation device, the second activation valve configured to activate or stop airflow between the first air bank system and the second air bank system.

4. The filling station system of claim 1, wherein at least one of the first air bank system and the second air bank system comprises a cascade air bank system.

5. The filling station system of claim 1, wherein at least one of the first activation device and the second activation device comprises a remote control line or control channel adapted to transmit a control signal between the first and second filling stations.

6. The filling station system of claim 5, wherein the control signal comprises a control signal air transmitted a low to medium pressure between about 50 psi to 250 psi.

7. The filling station system of claim 6, further comprising one or more additional filling stations connected in series with the first filling station or the second filling station, each of the one or more additional filling stations having an air bank system, and an air supply line connecting the air bank system to at least one other filling station, thereby to make available a volume of air from more than one air bank system at one of the filling stations.

8. The filling station system of claim 7, further comprising a user-operable activation device located at or near each filling station, a remote control line or control channel adapted to transmit a control signal between filling stations.

9. The filling station system of claim 8, wherein a control line or control channel is adapted to transmit a control signal to more than one filling station.

10. The filling station system of claim 1, wherein the first filling station and the second filling station are adapted to be placed in a recharging mode, whereby both the first filling station and the second filling station are recharged either from the location of the first filling station or the location of the second filling station.

11. A remote activation system for a breathing apparatus filling station, comprising:

a user-operable activation device for remotely activating air flow between a first filling station having a first air bank system and a remote second filling station having a second air bank system, the first filling station and the second filling station having an air supply line extending therebetween and a first activation valve coupled to the air supply line;

wherein the user-operable activation device is located at or near the first filling station, and adapted to transmit a remote control signal to activate the flow of air from the second air bank system to the first filling station via the first activation valve, whereby the volume of air from both first air bank system and second air bank system are available to recharge a breathing apparatus at the first filling station.

12. The remote activation system of claim 11, wherein the activation device comprises at least one control line or channel extending between the first filling station and the second filling station, the control line or channel adapted to transmit a control signal to start or stop the flow of air from the second air bank system to the first filling station.

13. The remote activation of claim 12, wherein the activation device is adapted to transmit a control signal air.

14. The remote activation system of claim 13, wherein the control signal air comprises a low to medium pressure between about 50 psi to 250 psi.

15. The remote activation system of claim 11, wherein the activation device comprises a wired or wireless electronic control device adapted to transmit a wired or wireless electronic control signal over a control line or control channel between the first filling station and the second filling station.

16. A method of operating a filling station system for a breathing apparatus, comprising:

providing a first filling station having a first air bank system;

providing a second filling station having a second air bank system;

providing a first air supply line extending between the first filling station and the second filling station, the first air supply line adapted to supply a flow of air from the first air bank system to the second filling station;

activating a first control signal at or near the second filling station to remotely activate the flow of air from the first air bank system to the second filling station; and providing a first activation valve coupled to the first air supply line and controlled by the first control signal, the first activation valve configured to activate or stop airflow between the first air bank system and the second air bank system.

17. The method of claim 16, further comprising:

providing a second air supply line extending between the second filling station and the first filling station, the second air supply line adapted to supply a flow of air from the second air bank system to the first filling station; and activating a second control signal at or near the first filling station to remotely activate the flow of air from the second air bank system to the first filling station.

18. The method of claim 17, further comprising providing a second activation valve coupled to the second air supply line and controlled by the second control signal, the second activation valve configured to activate or stop airflow between the first air bank system and the second air bank system.

19. The method of claim 16, wherein the method further comprises providing a cascade air bank system for at least one of the first air bank system and the second air bank system.

20. The method of claim 16, wherein activating the first control signal or the second control signal comprises transmitting a control signal air between the first and second filling stations over a remote control air line.

21. The method of claim 20, wherein the method further comprises transmitting the control signal air at a low to medium pressure between about 50 psi to 250 psi.

22. The method of claim 16, further comprising providing one or more additional filling stations connected in series with the first filling station or the second filling station, each of the one or more additional filing stations having an air bank system, and an air supply line connecting the air bank system to at least one other filling station.

23. The method of claim 16, wherein the method further comprises placing the first filling station and the second filling station into a recharging mode, and recharging both the first filling station and the second filling station either from the location of the first filling station or the location of the second filling station.

24. A method of operating a remote activation system for a breathing apparatus filling station, comprising:

providing a user-operable activation device located at or near a first filling station having a first air bank system;

connecting the first filling station to a second filling station having a second air bank system with at least a first air supply line, a first activation valve, and a first control line or channel; and remotely activating air flow from the second air bank system to the first filling station based on control of the first activation valve, whereby the volume of air from both first air bank system and second air bank system are available to recharge a breathing apparatus at the first filling station.

* * * * *